US011788344B2

(12) United States Patent
Sanders

(10) Patent No.: US 11,788,344 B2
(45) Date of Patent: Oct. 17, 2023

(54) GARAGE DOOR PANEL RAIL REINFORCEMENT DEVICES

(71) Applicant: Philip Sanders, Lakeland, FL (US)

(72) Inventor: Philip Sanders, Lakeland, FL (US)

( * ) Notice: Subject to any disclaimer, the term of this patent is extended or adjusted under 35 U.S.C. 154(b) by 579 days.

(21) Appl. No.: 16/805,822

(22) Filed: Mar. 1, 2020

(65) Prior Publication Data

US 2021/0270069 A1 Sep. 2, 2021

(51) Int. Cl.
*E06B 3/48* (2006.01)

(52) U.S. Cl.
CPC ..... *E06B 3/488* (2013.01); *E06B 3/485* (2013.01)

(58) Field of Classification Search
CPC ..... E06B 3/488; E06B 3/485; E06B 3/486; E06B 2003/7044; E05Y 2900/106; E05D 15/242; E05D 15/24
See application file for complete search history.

(56) References Cited

U.S. PATENT DOCUMENTS 2,738,839 A * 3/1956 Clark ..... E06B 3/485 160/229.1
4,641,469 A * 2/1987 Wood ..... E04F 13/0805 52/480
4,934,439 A * 6/1990 Martin ..... E04F 21/0007 52/291
5,555,923 A * 9/1996 Leist ..... E06B 3/7005 49/501
5,706,877 A * 1/1998 Grisham ..... E06B 5/12 292/DIG. 36
5,749,407 A * 5/1998 Brenner ..... E06B 3/485 160/229.1
5,857,510 A * 1/1999 Krupke ..... E05D 15/242 160/187
6,062,293 A * 5/2000 Berger, Jr. ..... E06B 3/485 52/801.12
6,148,896 A * 11/2000 Pinto ..... E06B 3/485 49/501
6,330,901 B1 * 12/2001 Friesen ..... E06B 3/485 160/229.1
7,861,763 B2 * 1/2011 Leist ..... E05D 15/16 52/745.19
RE43,251 E * 3/2012 Anderson ..... E06B 3/96 49/504
8,496,395 B2 * 7/2013 Miracle ..... E01F 15/085 404/6
8,627,872 B2 * 1/2014 Wedekind ..... E06B 3/485 160/229.1
9,249,622 B1 * 2/2016 Kelley ..... E06B 9/0638
9,353,538 B1 * 5/2016 Kelley ..... E06B 3/488
(Continued)

*Primary Examiner* — Justin B Rephann
(74) *Attorney, Agent, or Firm* — Cygnet IP Law, P.A.; Stephen W. Aycock, II

(57) ABSTRACT

Described is a garage door panel rail reinforcement device that is configured and constructed to be installed on an upper or lower rail of a "tongue and groove"-type garage door panel. Also, a garage door panel rail reinforcement device that is configured and constructed to be installed on an upper or lower rail of a "ship lap"-style garage door panel is described. Further, an adjustable garage door panel rail reinforcement device is described. In general, some implementations can be configured to fit other profiles of components forming a garage door rail disposed at a meeting point of two adjacent garage door panels.

5 Claims, 20 Drawing Sheets

(56) References Cited

U.S. PATENT DOCUMENTS

| | | | | |
|---|---|---|---|---|
| 9,777,530 | B1 * | 10/2017 | Haba | E06B 3/48 |
| 2003/0205340 | A1 * | 11/2003 | Nadar | E06B 3/485<br>160/236 |
| 2005/0257901 | A1 * | 11/2005 | Berger, Jr. | E06B 3/485<br>160/229.1 |
| 2006/0137835 | A1 * | 6/2006 | Mullet | E06B 3/485<br>160/236 |
| 2007/0044927 | A1 * | 3/2007 | Mullet | E05D 15/242<br>160/201 |
| 2009/0223131 | A1 * | 9/2009 | Wiese | E06B 3/7001<br>49/506 |
| 2012/0111508 | A1 * | 5/2012 | Wedekind | E06B 3/485<br>160/127 |
| 2013/0126544 | A1 * | 5/2013 | Klem | B29C 51/02<br>220/810 |
| 2014/0345810 | A1 * | 11/2014 | Nofziger | E06B 3/488<br>160/181 |
| 2016/0251892 | A1 * | 9/2016 | Nofziger | E06B 3/488<br>160/181 |
| 2017/0247937 | A1 * | 8/2017 | Haba | E06B 3/54 |
| 2017/0335622 | A1 * | 11/2017 | Nemeth | E06B 3/488 |
| 2019/0003242 | A1 * | 1/2019 | Schank | E06B 3/488 |
| 2020/0340291 | A9 * | 10/2020 | Schank | E06B 3/485 |

* cited by examiner

GARAGE DOOR PANEL RAIL REINFORCEMENT DEVICES

TECHNICAL FIELD

Embodiments relate generally to garage doors, and more particularly, to devices for reinforcing garage door panel rails.

BACKGROUND

Garage door panels may bend, deform, split or develop cracks along an upper or lower rail of the panels. The bends, deformations, splits or cracks may cause a load on the panel to be transferred to other areas of the same panel or to different panels. A bend, deformation, split or crack may also enlarge when the garage door is used. Bends, deformations, cracks or splits in garage door panel rails can cause the garage door to malfunction, may cause damage to other components of the garage door and may ultimately lead to failure of the garage door system.

Embodiments were conceived in light of the above, among other things.

SUMMARY

Some implementations can include a garage door panel rail reinforcement device that is configured and constructed to be installed on an upper or lower rail of a "tongue and groove"-type garage door panel. Some implementations can include a garage door panel rail reinforcement device that is configured and constructed to be installed on an upper or lower rail of a "ship lap"-style garage door panel.

DETAILED DESCRIPTION

It will be appreciated that the example garage door panel reinforcement devices shown herein may be formed from extruded metal (e.g., extruded aluminum) to reduce weight and cost, among other things, and may be attached to the garage door panel using an interference fit, a screw, a nut and bolt, a rivet, welding, brazing, an adhesive or the like.

Figure 1:
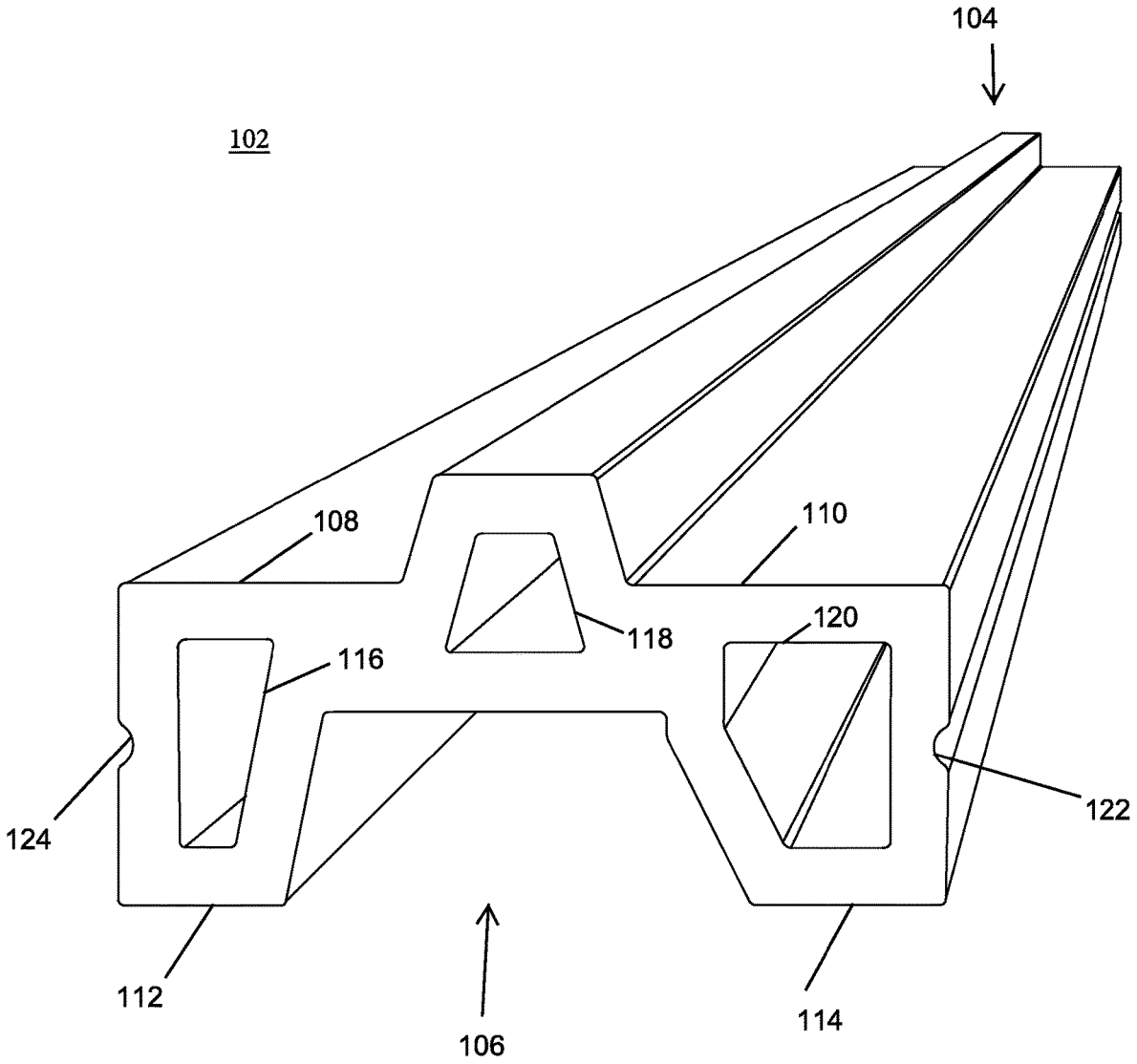
FIGS. 1-2 are diagrams of an example garage door panel reinforcement device for a tongue in groove style garage door in accordance with some implementations.
Figure 2:
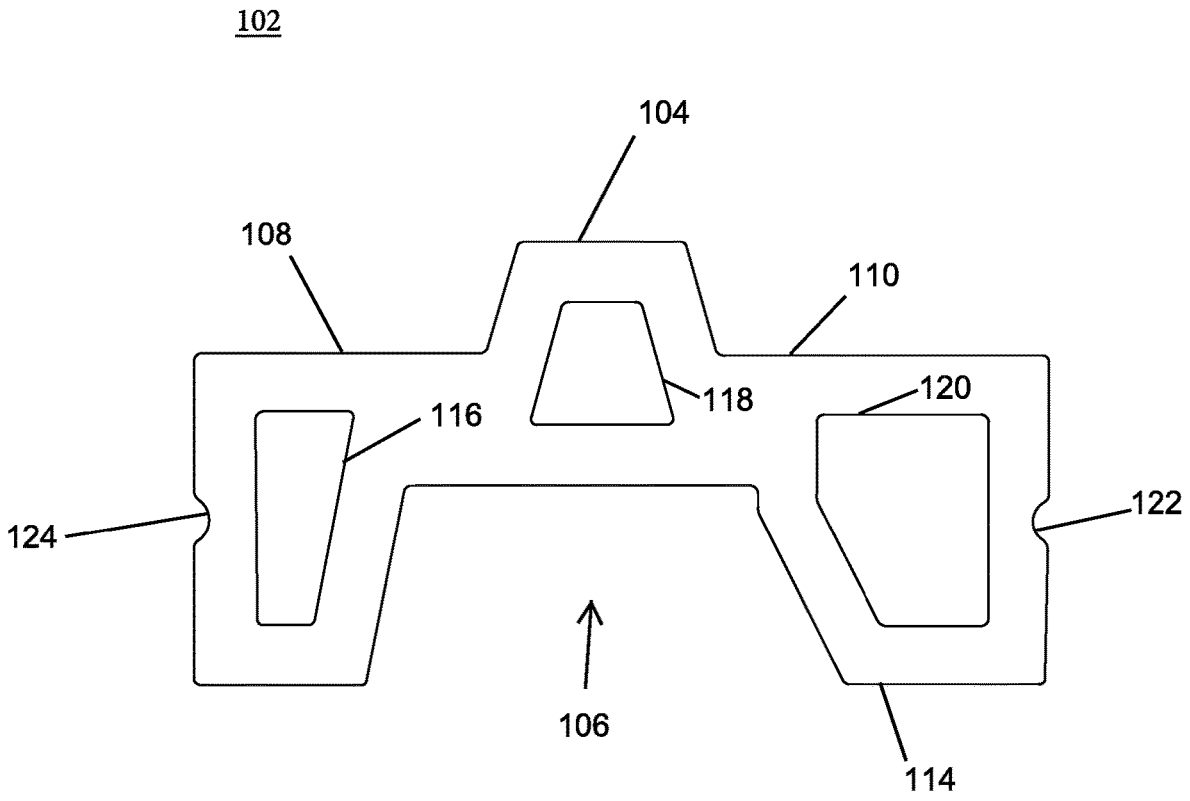

FIG. 1-2 are diagrams showing an example tongue and groove garage door panel rail reinforcement device 102 in accordance with some implementations. The device can be formed from metal (e.g., extruded aluminum, etc.), plastic (e.g., PVC), wood, composite (e.g., fiberglass, carbon fiber, etc.), or other suitable material and can be made in a color (e.g., black) to match the color of the garage door panel to provide an aesthetically pleasing appearance.

Figure 18:
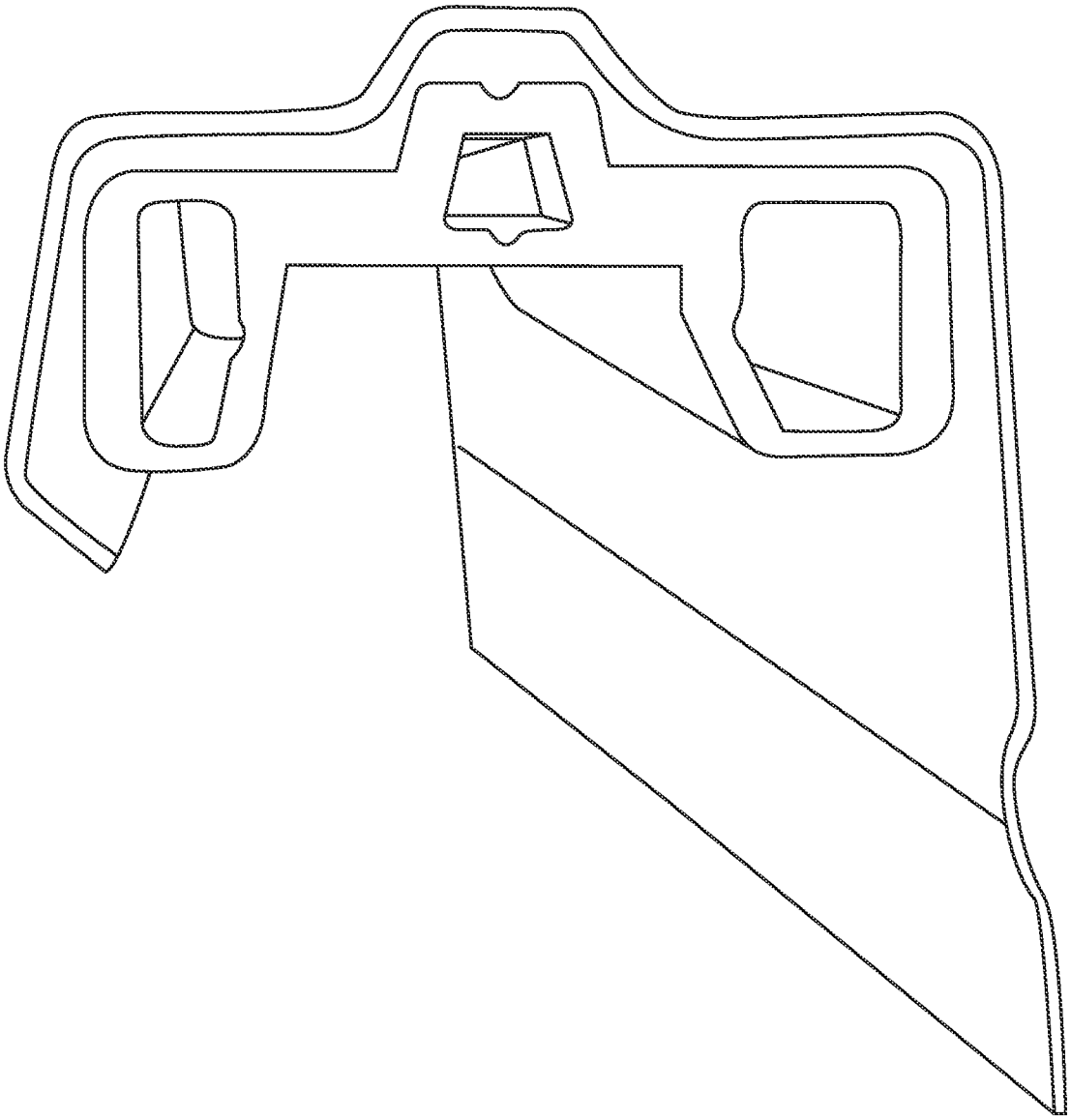
FIGS. 18 and 19 are diagrams of an example garage door panel reinforcement device installed in an upper rail in accordance with some implementations.
Figure 19:
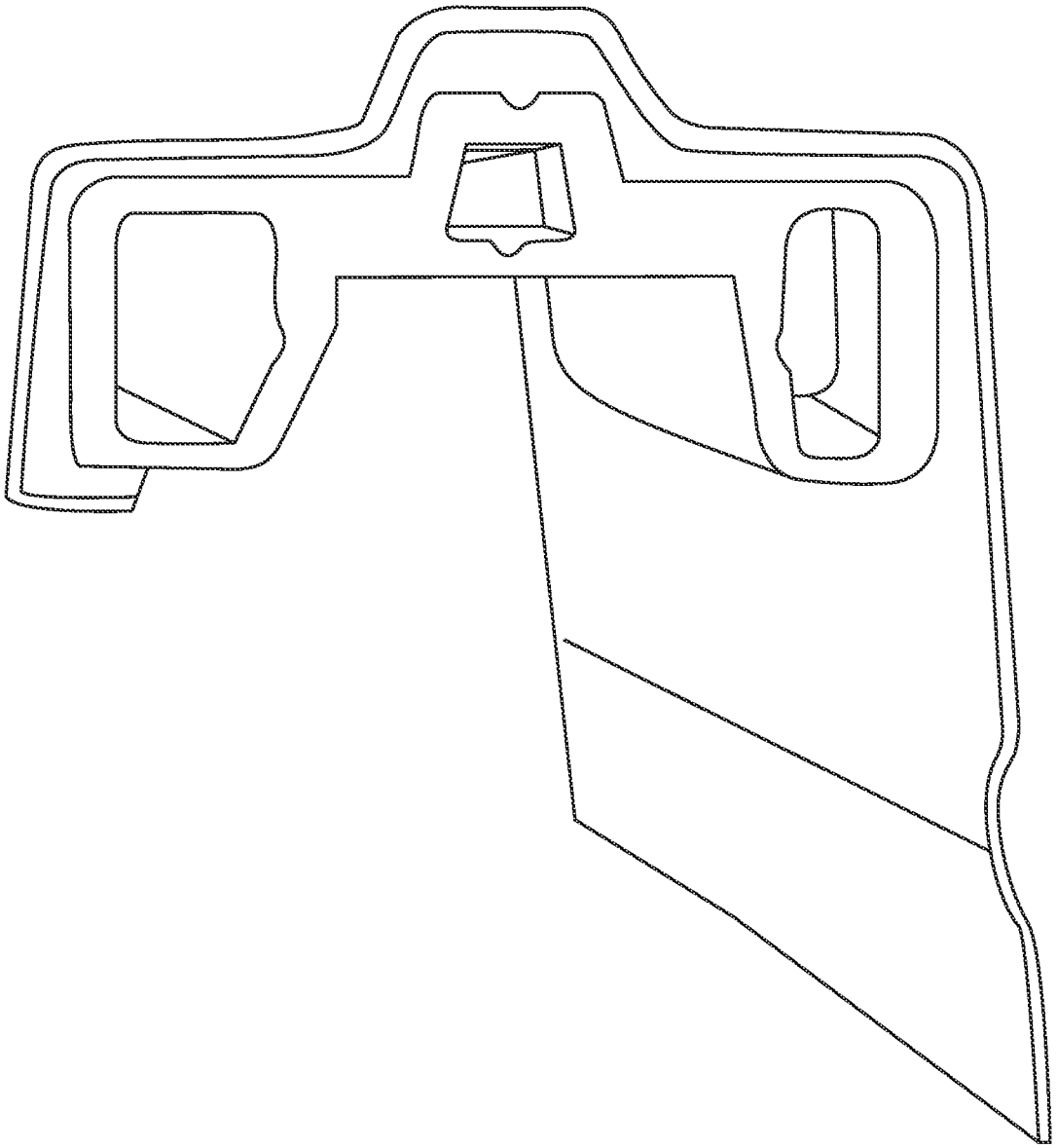
Figure 20:
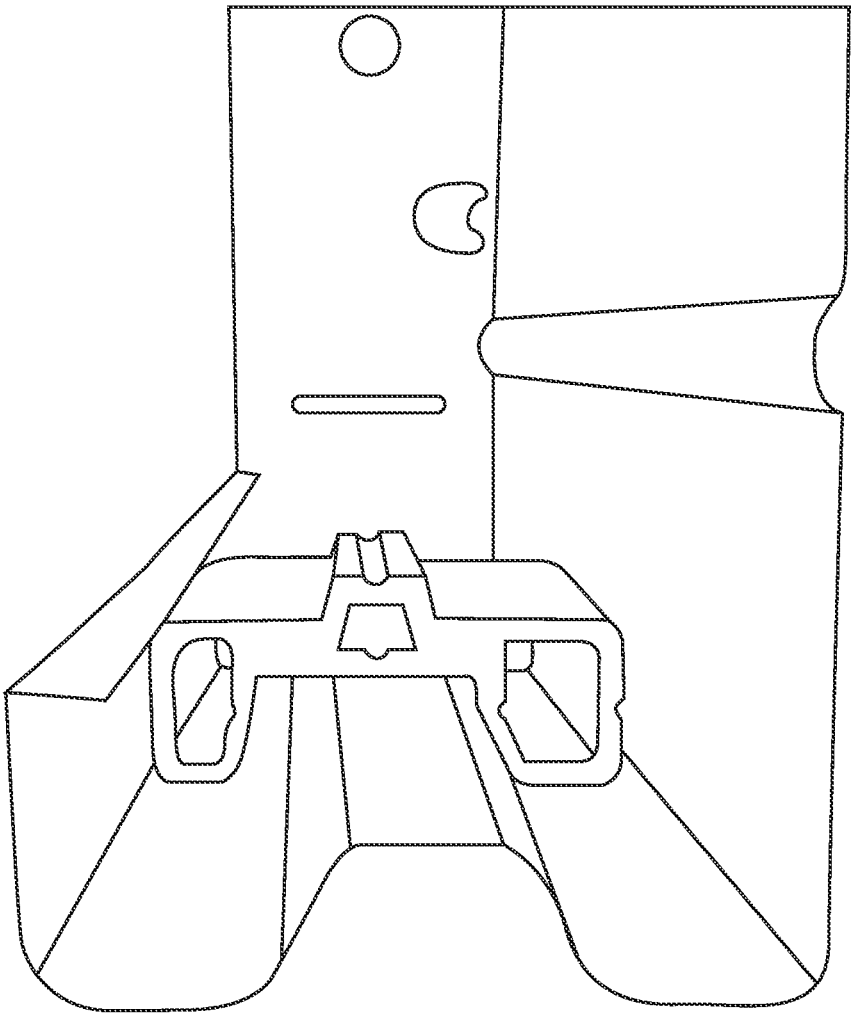
FIG. 20 is a diagram of an example garage door panel reinforcement device installed in a lower rail in accordance with some implementations.

The device 102 can include a top portion 104 and a bottom portion 106. The top portion 104 can be configured to fit under an upper rail of a tongue and groove style garage door panel as shown in FIGS. 18 and 19. The bottom portion 106 can be configured to fit on top of a lower rail of a tongue and groove style garage door panel as shown in FIG. 20. The device 102 can include a first top surface 108 and a second top surface 110, a first bottom surface 112 and a second bottom surface 114. The device can also include one or more extrusion openings 116, 118, and 120. The device 102 can further include a first detent 122 and a second detent 124. The first and second detents 122/124 can be used to engage one or more shims (see, e.g., FIGS. 5-7) or to help align a fastener (e.g., a screw).

Garage door panel manufacturers may manufacture tongue and groove garage door panels with upper and lower rail dimensions that may differ from manufacturer to manufacturer. Accordingly, the upper portion 104 and lower portion 106 are configured with tolerances in the tongue and groove dimensions (e.g., width, height, and/or angles) so as to be potentially compatible with tongue and groove style garage door panels of different dimensions and/or from more than one manufacturer.

Figure 3:
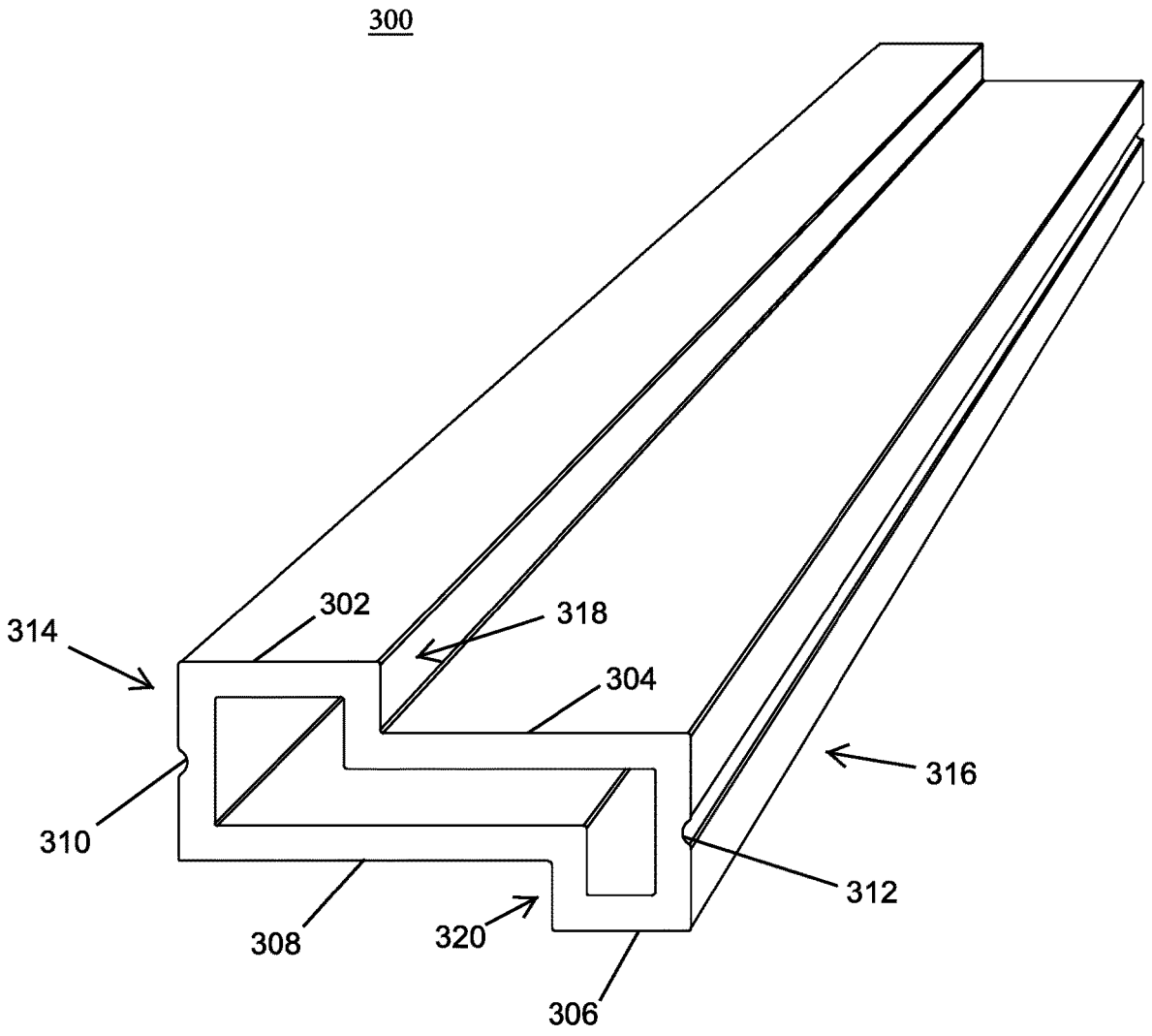
FIGS. 3-4 are diagrams of an example garage door panel reinforcement device for a ship lap style garage door in accordance with some implementations.
Figure 4:
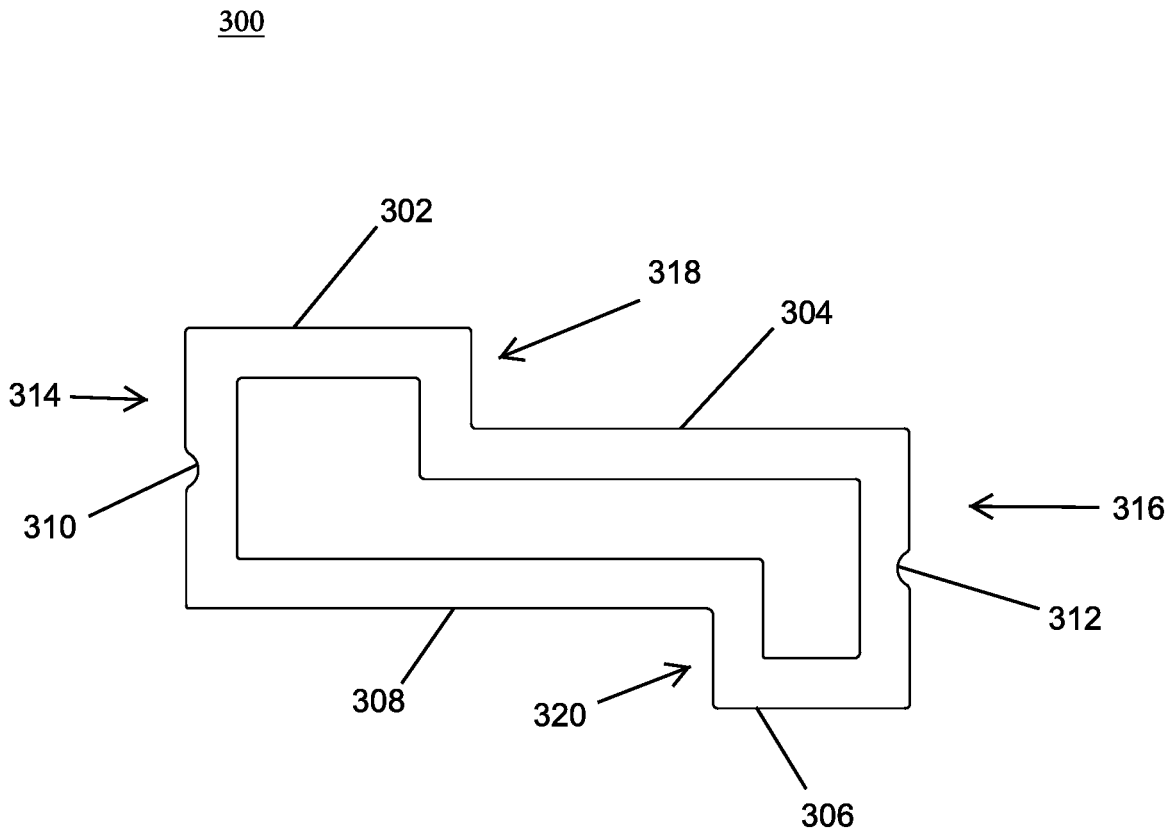

FIGS. 3 and 4 show an example ship lap style garage door panel rail reinforcement device 300 having a first upper surface 302, a second upper surface 304, a first bottom surface 306, a second bottom surface 308, a first detent 310, a second detent 312, a first side 314 and a second side 316, a first vertical surface 318 joining the first and second upper surfaces, and a second vertical surface 320 joining the first and second bottom surfaces.

Figure 5:
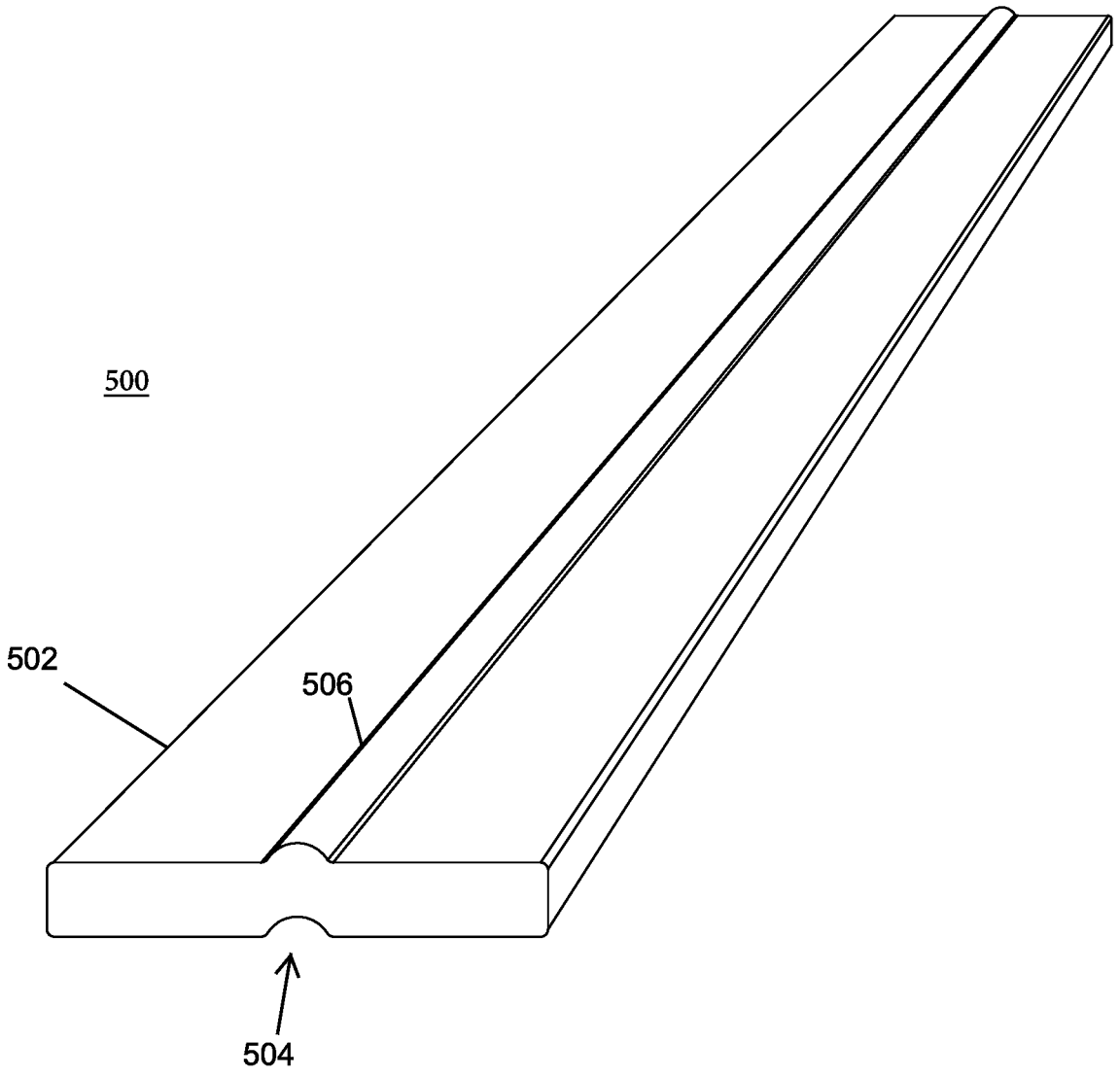
FIGS. 5-6 are diagrams of an example shim for a garage door panel reinforcement device in accordance with some implementations.
Figure 6:
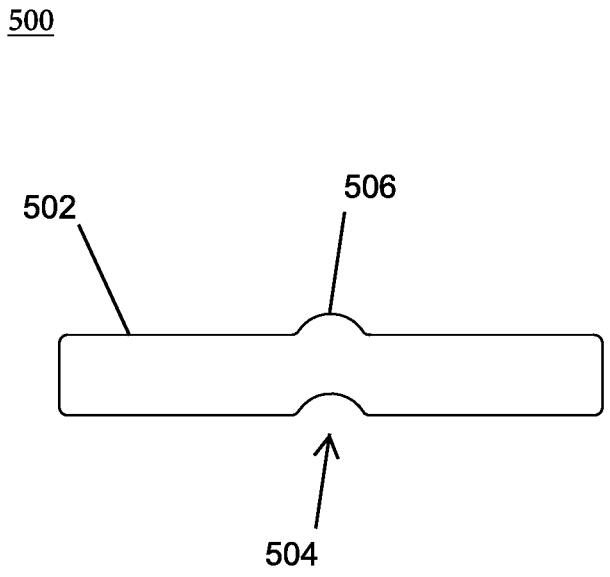

FIGS. 5-6 are diagrams of an example shim 500 for use with any of the garage door panel rail reinforcement devices described herein (e.g., 102 and/or 200). The shim includes a body portion 502 with a positive detent 506 and a negative detent 504. The positive detent 506 is configured to engage a corresponding detent on a garage door panel rail reinforcement device (e.g., 122, 124, 310, or 312). The negative detent 504 is configured to engage the positive detent of an adjacent shim (see, e.g., FIG. 8).

Figure 7:
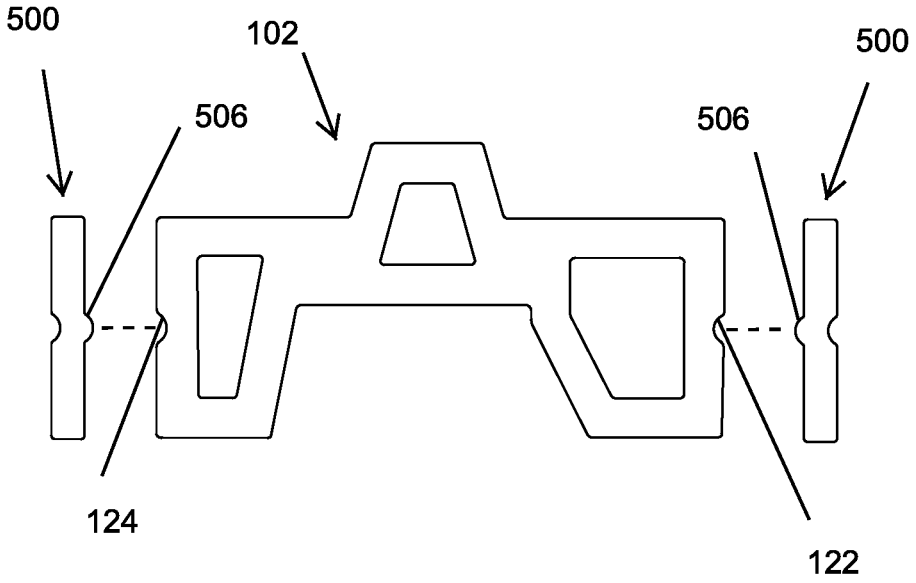
FIG. 7 is a diagram of example shims in use with a garage door panel reinforcement device for a tongue in groove style garage door in accordance with some implementations.

FIG. 7 is a diagram of example shims 500 in use with a garage door panel reinforcement device 102 for a tongue in groove style garage door in accordance with some implementations. The positive detents 506 of the shims are configured to engage with the detents 124, 122 on the device 102. The shims are to provide additional dimension to the device 102 in order to fit or align with a given garage door panel.

Figure 8:
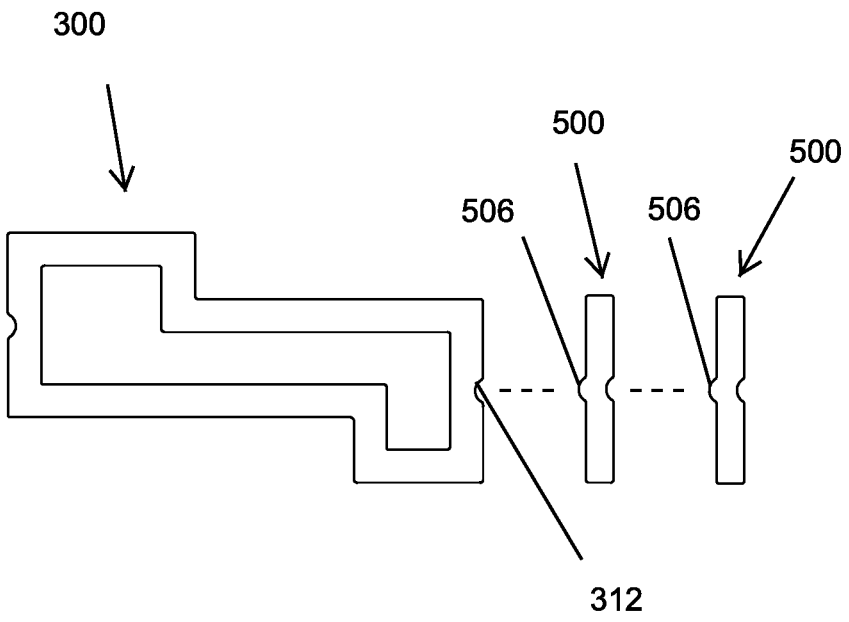
FIG. 8 is a diagram of example shims in use with a garage door panel reinforcement device for a ship lap style garage door in accordance with some implementations.

FIG. 8 is a diagram of example shims 500 in use with a garage door panel reinforcement device 300 for a ship lap style garage door in accordance with some implementations. The positive detents 506 of the shims are configured to engage with detent 312 on the device 102 and with the negative detent on an adjacent shim 500. The shims 500 are to provide additional dimension to the device 300 in order to fit or align with a given garage door panel.

Figure 9:
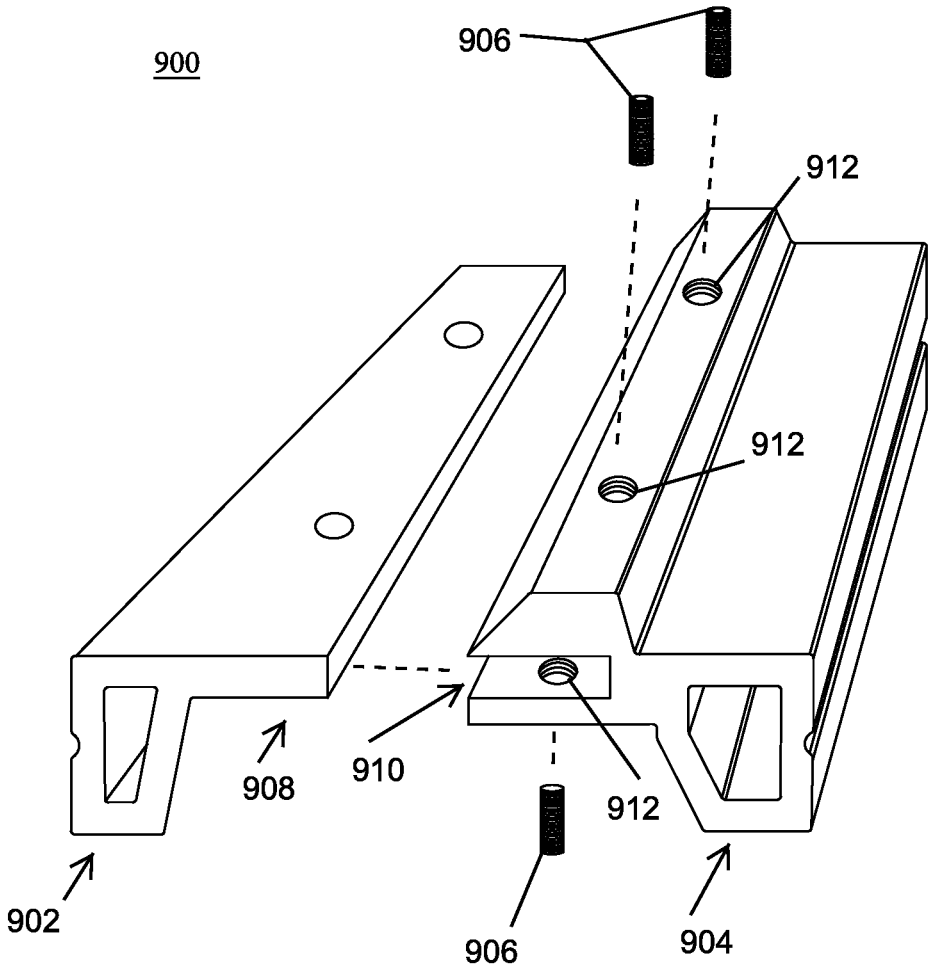
FIGS. 9-10 are diagrams of an example adjustable garage door panel reinforcement device in accordance with some implementations.
Figure 10:
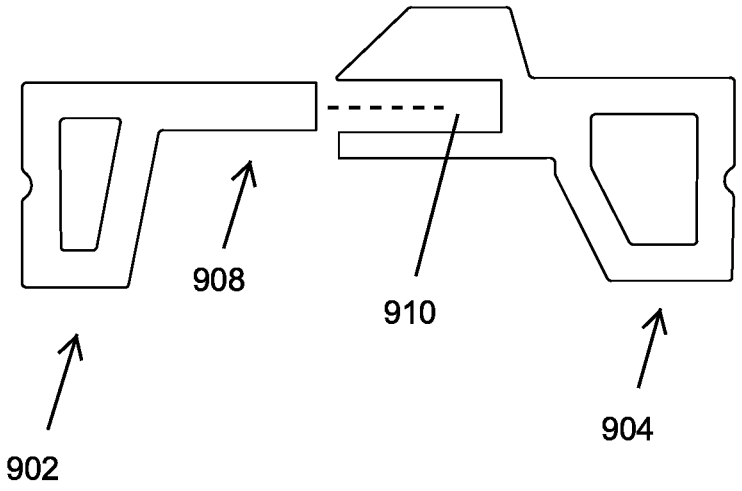

FIGS. 9-10 are diagrams of an example adjustable garage door panel reinforcement device 900 in accordance with some implementations. The device 900 includes a first portion 902 and a second portion 904. The first portion 902 includes a connection member 908 that is configured to slide into an aperture 910 on the second portion 904. Once the connection member 908 is at a desired position within the aperture 910, a plurality of set screws 906 can be inserted into threaded apertures 912 and tightened down to secure the two portions (902 and 904) together at a given width to suit a contemplated application.

Figure 11:
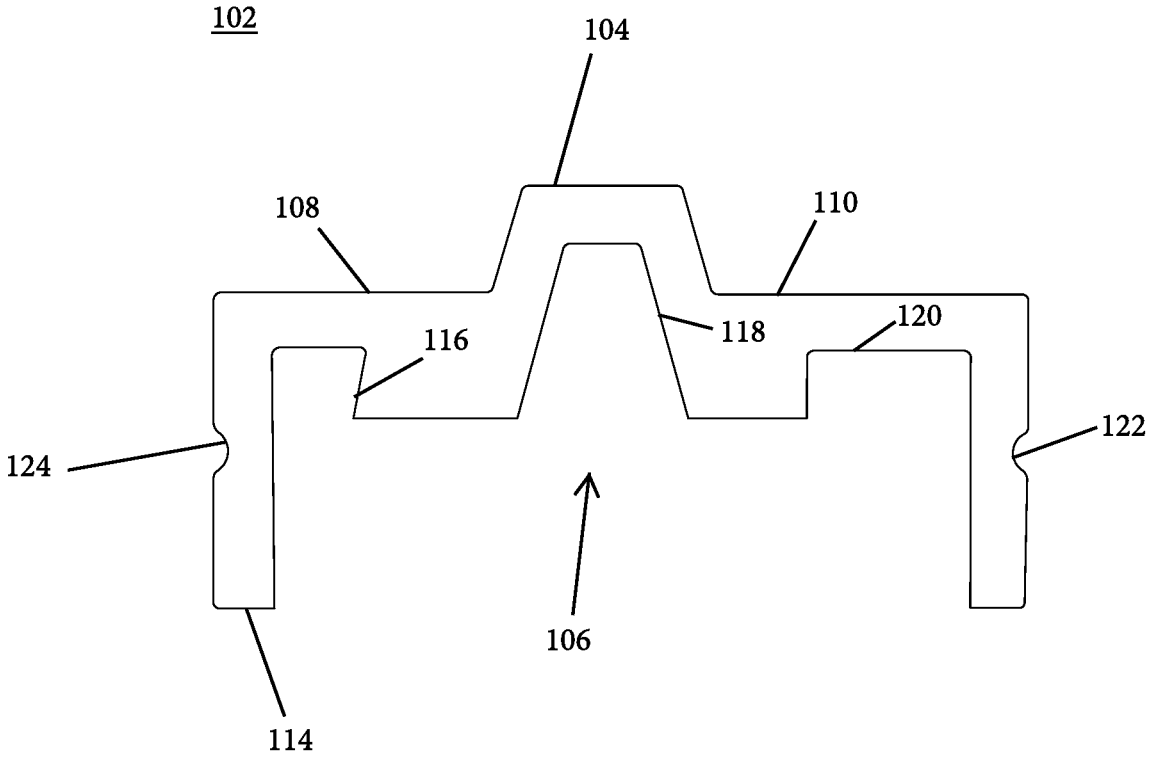
FIG. 11 is a diagram of an example garage door panel reinforcement device for a tongue in groove style garage door in accordance with some implementations.
Figure 14:
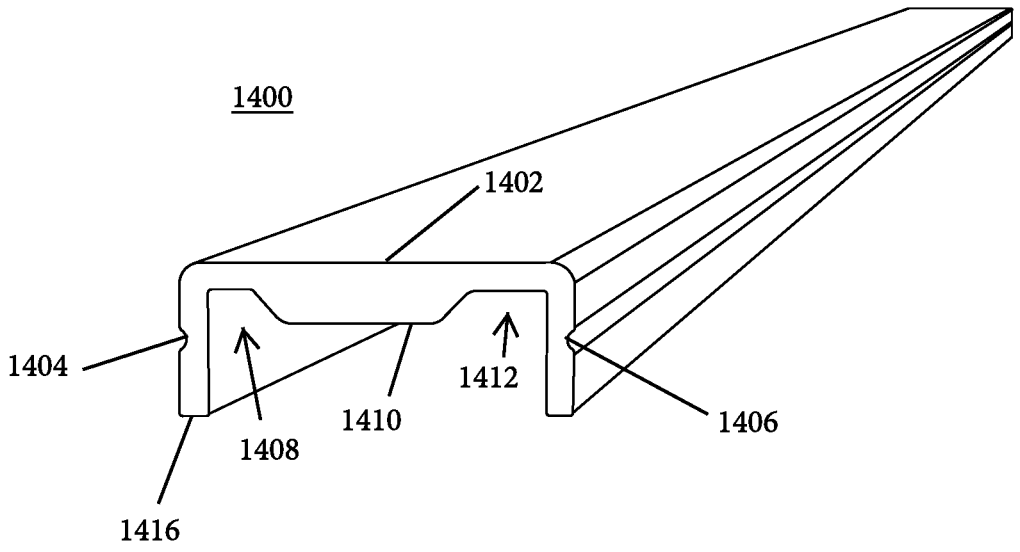
FIGS. 14 and 15 are diagrams of an example garage door panel reinforcement device for a tongue in groove style garage door in accordance with some implementations.

It will be appreciated that some non-load bearing, or otherwise potentially unnecessary portions of a reinforcement device may be omitted. For example, FIGS. 11 and 14 show an example implementation of the reinforcement device of FIG. 1 with some material removed.

Figure 12:
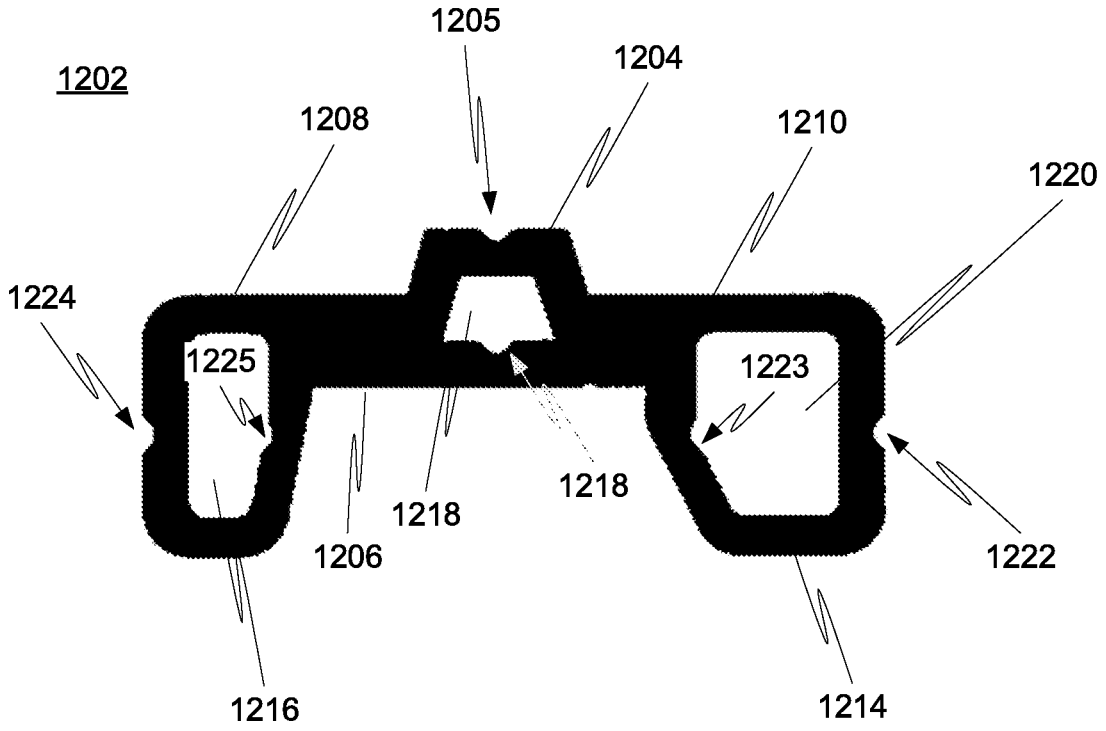
FIG. 12 is a diagram of an example garage door panel reinforcement device for a tongue in groove style garage door in accordance with some implementations.

FIG. 12 is a diagram of an example garage door panel reinforcement device 1202 for a tongue in groove style garage door in accordance with some implementations. The device can be formed from metal (e.g., extruded aluminum, etc.), plastic (e.g., PVC), wood, composite (e.g., fiberglass, carbon fiber, etc.), or other suitable material and can be made in a color (e.g., black) to match the color of the garage door panel to provide an aesthetically pleasing appearance.

The device 1202 can include a top portion 1204 and a bottom portion 1206. The top portion 1204 can be configured to fit under an upper rail of a tongue and groove style garage door panel. The bottom portion 1206 can be configured to fit on top of a lower rail of a tongue and groove style garage door panel. The device 1202 can include a first top surface 1208 and a second top surface 1210, a first bottom surface 1212 and a second bottom surface 1214. The device can also include one or more extrusion openings 1216, 1218, and 1220. The device 1202 can further include a plurality of detents 1205, 1218, 1222, 1223, 1224, and 1225 to help align a fastener (e.g., a screw) as it is being inserted.

Figure 13:
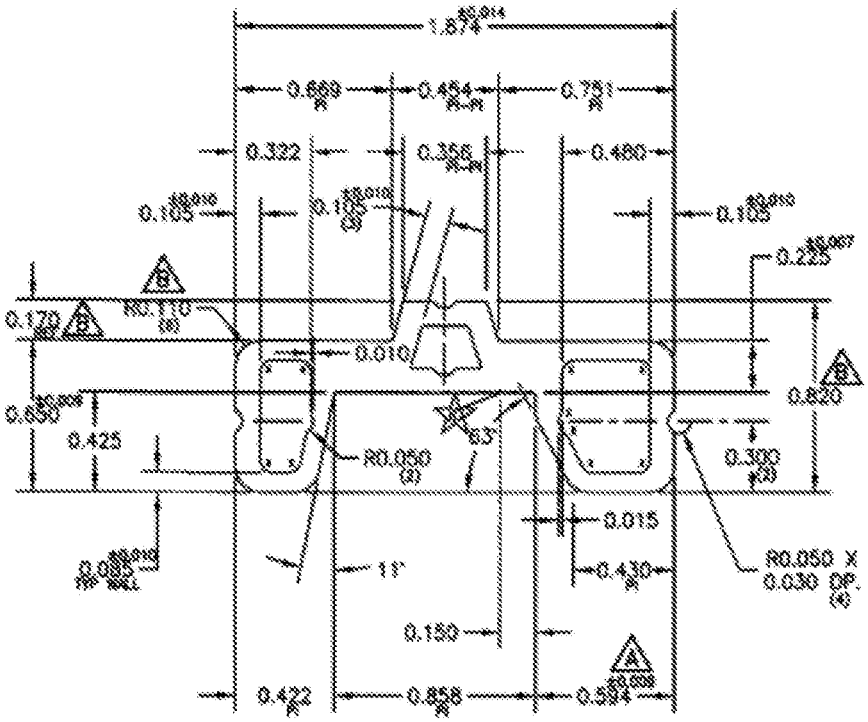
FIG. 13 is a diagram of an example garage door panel reinforcement device for a tongue in groove style garage door in accordance with some implementations.

FIG. 13 is a diagram of an example garage door panel reinforcement device of FIG. 12 for a tongue in groove style garage door with some example dimensions shown. It will be appreciated that other dimensions could be used.

Figure 15:
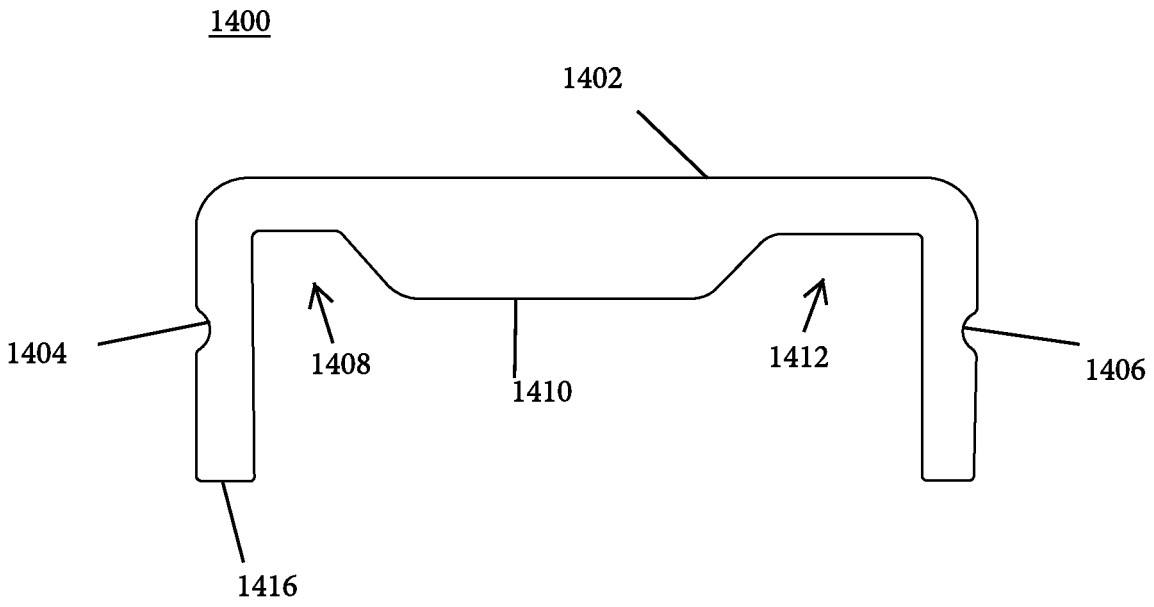

FIGS. 14 and 15 are diagrams of an example garage door panel reinforcement device 1400 for a tongue in groove style garage door in accordance with some implementations. The device 1400 functions similar to other implementations disclosed herein and includes some material removed in comparison with the example implementation of FIG. 1. The device 1400 includes a flat top surface 1402, a first detent 1404, a second detent 1406, a first bottom surface 1408, a second bottom surface 1410, a third bottom surface 1412, and a bottom edge 1406.

Figure 16:
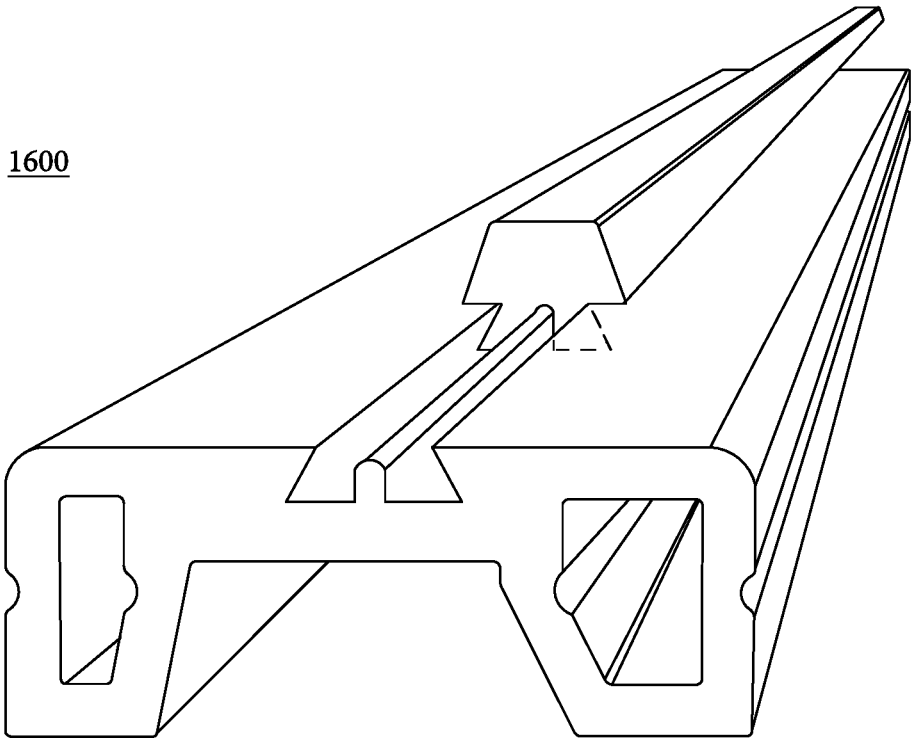
FIGS. 16 and 17 are diagrams of an example tongue-in-groove garage door panel reinforcement device with removable top section in accordance with some implementations.
Figure 17:
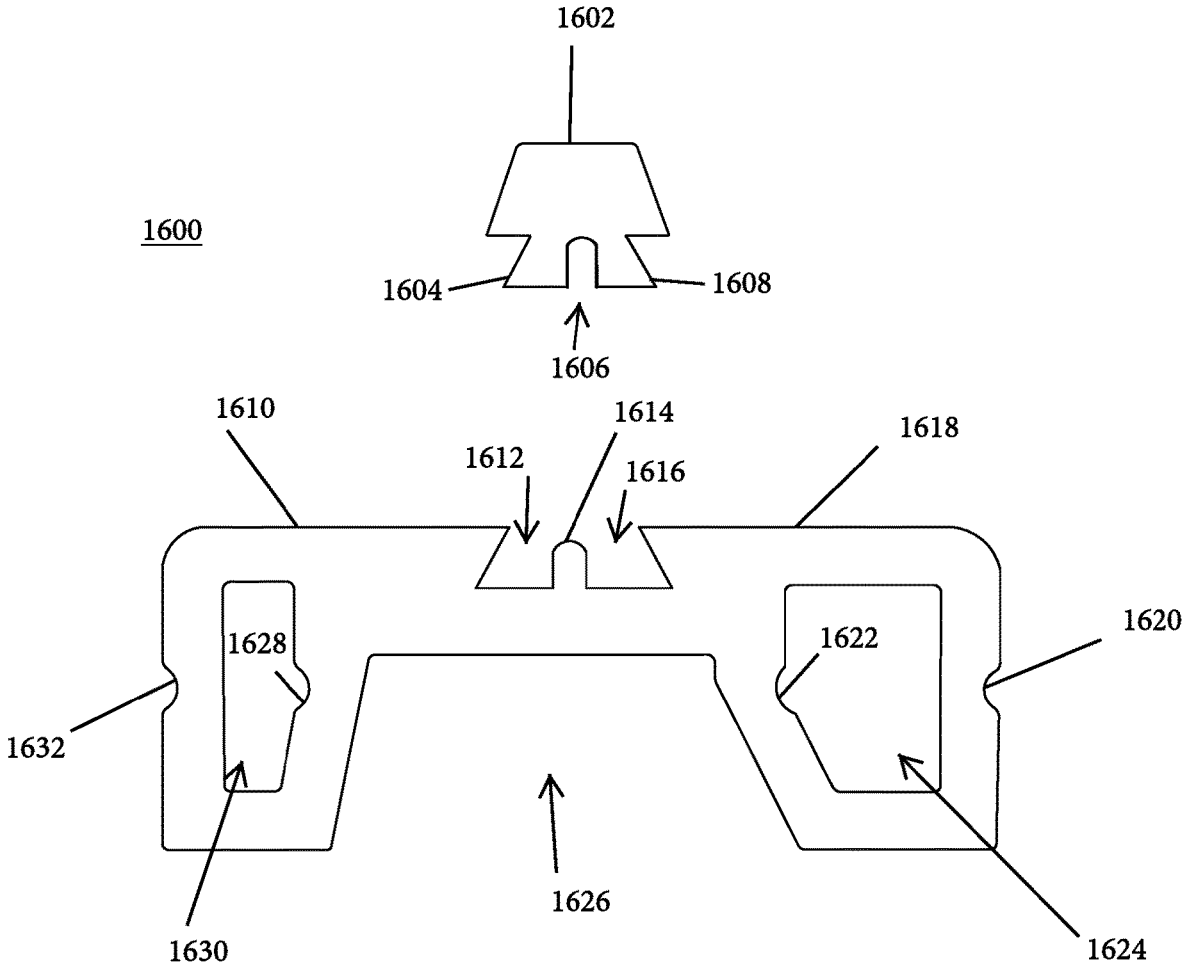

FIGS. 16 and 17 are diagrams of an example tongue-in-groove garage door panel reinforcement device 1600 with removable top section in accordance with some implementations. The device 1600 includes a removable top section 1602 having a first protrusion 1604, a recess 1606, and a second protrusion 1608, which are configured to slide into s corresponding recess 1612, protrusion 1614, and second recess 1616 on the body portion of the device 1600.

The device 1600 also includes a first top surface 1610, a second top surface 1618, a first side detent 1632, a first cavity 1630, a second detent 1628, a bottom surface 1626, a second cavity 1624, a third detent 1620, and a fourth detent 1622. The detents (1620, 1622, 1628, and 1632) can help keep a fastener (e.g., a screw) aligned when being inserted.

In operation, the device 1600 can have the top section 1602 inserted when needed in a given application or removed when not needed in an application. By being slidable in the top surface, the device 1600 provides a device that is convertible between a device having a top section 1602 and a device not having a top section.

The adjustable garage door panel reinforcement device can also include a device for a ship lap style door.

Optionally, one or more plates can be used to help secure a garage door panel rail reinforcement device (e.g., 102, 302, or 1202) to a garage door panel. The one or more plates can be placed on an exterior of the panel (e.g., the front and/or back of the panel) and attached with a fastener (e.g., screw or bolt) through the plate, through garage door panel and into the garage door panel rail reinforcement device.

In general, some implementations can be configured to fit other profiles of components forming a garage door rail disposed at a meeting point of two adjacent garage door panels.

It is, therefore, apparent that there is provided, in accordance with the various embodiments disclosed herein, devices for repairing and/or reinforcing garage door panel rails.

While the disclosed subject matter has been described in conjunction with a number of embodiments, it is evident that many alternatives, modifications and variations would be, or are, apparent to those of ordinary skill in the applicable arts. Accordingly, Applicant intends to embrace all such alternatives, modifications, equivalents and variations that are within the spirit and scope of the disclosed subject matter.

What is claimed is:

1. A garage door panel rail reinforcement device configured for a tongue-in-groove style garage door, the garage door panel rail reinforcement device comprising:

a top portion having a first top surface and a second top surface, wherein the top portion is configured to fit under an upper rail of a tongue and groove style garage door panel, wherein the first top surface is offset, wherein the first top surface is a first distance from a first side of the garage door panel rail reinforcement device and is a second distance from a second side of the garage door panel rail reinforcement device, wherein the first distance is different than the second distance;

a bottom portion having a first bottom surface and a second bottom surface, wherein the bottom portion is configured to fit on top of a lower rail of the tongue and groove style garage door panel; and a fastener piloting detent disposed on the first top surface of the top portion, wherein the garage panel reinforcement device is an extrusion formed by an extrusion process and includes a plurality of interior cavities within the extrusion, wherein the garage panel reinforcement device is configured to support the upper rail of the tongue and groove style garage door panel when installed under the upper rail, and is configured to support the lower rail of the tongue and groove style garage door panel when installed above the lower rail, and wherein the top portion and the bottom portion each include rounded corner transitions between one or more surfaces.

2. The garage door panel rail reinforcement device of claim 1, further comprising a first detent disposed on the first side of the garage door panel rail reinforcement device and a second detent disposed on the second side of the garage door panel rail reinforcement device, wherein the first detent and the second detent are configured to engage one of a shim or a fastener.

3. The garage door panel rail reinforcement device of claim 2, further comprising one or more shims, wherein each shim has a positive detent on a first shim side and a negative detent on a second shim side, and wherein the positive detent is configured to engage one of the first detent or second detent.

4. The garage door panel rail reinforcement device of claim 1, wherein the garage door panel rail reinforcement device is formed from one of metal or plastic.

5. The garage door panel rail reinforcement device of claim 1, wherein the garage door panel rail reinforcement device is attached to the garage door panel using a screw, a nut and bolt, a rivet, welding, brazing, or an adhesive.

* * * * *